United States Patent [19]

Mohaupt

[11] 3,999,384

[45] Dec. 28, 1976

[54] THRUST GENERATOR

[75] Inventor: Udo H. Mohaupt, Waterloo, Canada

[73] Assignee: Institute of Gas Technology, Chicago, Ill.

[22] Filed: Oct. 14, 1975

[21] Appl. No.: 621,687

[52] U.S. Cl. ..... 60/327; 60/371; 60/414; 60/416

[51] Int. Cl.[2] ..... F15B 1/02; F15B 15/22

[58] Field of Search ..... 60/327, 369, 371, 414, 60/416

[56] References Cited

UNITED STATES PATENTS

| | | | |
|---|---|---|---|
| 2,665,551 | 1/1954 | Chenault | 60/414 |
| 2,881,739 | 4/1959 | Huppert | 60/371 X |
| 3,058,310 | 10/1962 | Panissidi | 60/327 X |
| 3,150,488 | 9/1964 | Haley | 60/371 |

*Primary Examiner*—Edgar W. Geoghegan
*Attorney, Agent, or Firm*—Thomas W. Speckman

[57] ABSTRACT

A hybrid hydraulic-pneumatic thrust generator wherein pneumatic action is used for cocking and for cushioning while hydraulic action is used for providing the driving force. The thrust generator of this invention has a relatively flat thrust pattern making is especially suitable as a driving mechanism for high velocity water jets for fracturing concrete and the like.

11 Claims, 4 Drawing Figures

THRUST GENERATOR

Thrust generators are devices for generating forces to perform various types of work. Presently available thrust generators generally have a configuration of a power piston and a connecting piston rod free to move in axial directions upon the application of a force. The force applied to the power piston may be hydraulic, pneumatic, combustion and other means. The connecting piston rod transmits the applied force to the means for doing the desired work. Such force generating devices are also known as actuators, intensifiers and hydraulic or pneumatic hammers, depending upon their application which may range from lifting loads to generating high velocity water jets.

Typical prior art hydraulic thrust generators utilize a dumping principle for generating the thrust whereby a power piston is cocked to firing position under pressure by a high pressure hydraulic oil. Sudden release of the high pressure hydraulic oil frees the power piston, thus generating the thrust. Such devices require the use of expensive and undesirably bulky valves of high flow capacity to provide release of the hydraulic oil for fast operation to avoid detrimental back pressures. Such devices also require precision made cushion plunger and cushion port to decelerate and stop the power piston at the end of the power stroke with the sacrifice of a significant amount of the useful energy. To overcome the back pressure generated by insufficient flow and release of the hydraulic oil, some hydraulic thrust generators have incorporated mechanical or hydraulic latching devices to hold the power piston in a firing position so that the cocking pressure of the hydraulic oil can be relieved in advance of the movement of the power piston in its thrust stroke. However, such latching devices are not entirely satisfactory since they are prone to wear and malfunction.

Pneumatic thrust generators have previously been employed but they have short strokes and high reciprocating rates. Such devices are generally operated on the principle of exhausting a cocking gas and are noisy in operation, such as the common pneumatic tools such as jack hammers. Some pneumatic thrust generators are capable of long stroke operation by use of a latching principle in which the power piston is held at firing position at low cocking pressures. However, such devices are prone to wear and damage to the latching seals which causes premature firing. Such devices are known to have non-flat thrust patterns exhibiting a sharp reduction of available thrust during the power stroke.

Pneumatic thrust generators are also known which operate on the principle of combustion as commonly employed in reciprocating engines. This type of thrust generator requires the exhaust of combusted gas and are thus noisy. Further, the thrust pattern of the combustion thrust generator is non-flat, the force being sharply reduced during the power stroke.

It is an object of this invention to provide a thrust generator and process which overcomes many of the disadvantages of thrust generators presently available.

One object of the invention is to provide a thrust generator which utilizes a hydraulic-pneumatic hybrid means to drive and to stop a power piston for the production of thrust of a wide range of force levels, stroke lengths, and reciprocating rates.

Another object of the invention is to provide a thrust generator which utilizes a check valve which permits rapid decceleration of power piston at the end of a power stroke without significant sacrifice of useful energy and the need for precision-made piston cushion plunger and cushion port making fast reciprocation of the power piston possible.

Still another object of the invention is to provide a thrust generator which utilizes a valve actuator which initiates and controls the thrust pattern of the power stroke without the requirement of seals.

Yet another object of the invention is to provide a valve control for the operation of the thrust generator so that its firing, stopping and reciprocation rate may be controlled.

A further object of the invention is to provide a thrust generator which utilizes a floating piston permitting the separation of driving gas from the working fluid and provides alignment to the function of a check valve.

A still further object of the invention is to provide a thrust generator with coaction of the check valve and high pressure oil valves control by electrical, hydraulic, pneumatic or mechanical means derived from pressure sensing means or position sensing means, such as the use of pressure transducers, position sensors, and contact switches. Other objects and advantages of the invention will become apparent from the following description taken in conjunction with the accompanying drawings showing preferred embodiments in which.

Figure 1:
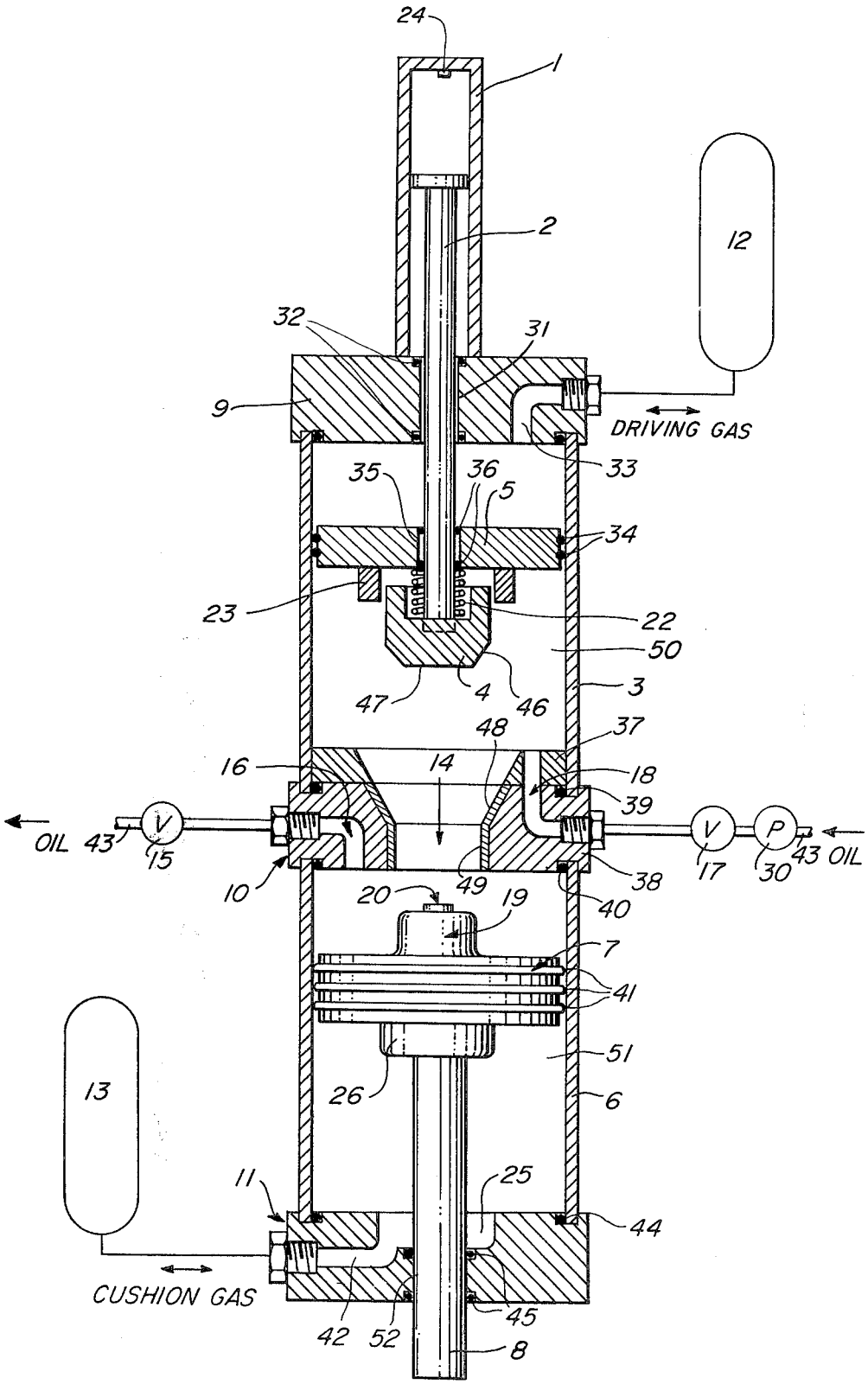
FIG. 1 is a partially sectioned view of one embodiment of a hydraulic-pneumatic thrust generator of this invention.

Referring to FIG. 1, showing the apparatus of one preferred embodiment of this invention, the thrust generator comprises interconnected driving cylinder 50 and cocking cylinder 51. Driving cylinder 50 comprises driving cylinder wall 3, driving cylinder end 9 at one end and driving cylinder end 37 at the other end adjacent cocking cyliner 51. Within driving cylinder 50 is floating piston 5 adapted for substantially gas-tight reciprocating movement within driving cylinder 50 by floating piston seals 34 between floating piston 5 and driving cylinder wall 3. In the central portion of floating piston 5 is poppet rod hole 35 having poppet rod 2 extending therethrough with poppet valve 4 at the lower end of poppet rod 2. Poppet rod 2 is adapted for reciprocating movement through poppet rod hole 35 in substantially gas-tight relationship created by poppet rod seals 36. Driving cylinder end 9 has poppet rod hole 31 extending through the central portion adapted for substantially gas-tight reciprocation of poppet rod 2 by seals 32. The exterior end of poppet rod 2 is covered by poppet rod cover 1 in which position switch 24 may be located.

Cocking cylinder 51 is in communication with driving cylinder 50 and comprises cocking cylinder wall 6, cocking cylinder end 11 at one end and cocking cylinder end 10 adjacent driving cylinder 50. As shown, cocking cylinder end 10 and driving cylinder end 37 are separate structures, but in actual practice, they may be opposite sides of a single piece of material. Extending through driving cylinder end 37 and cocking cylinder end 10, in the central portion, is driving port 14. A portion of the wall of driving port 14 comprises replaceable valve seat 48 constructed so as to engage poppet valve taper 46. The lower portion of driving port 14 is constructed to provide desired clearance with poppet actuator 19. This clearance is designed to control the driving stroke of power piston 7, allowing sufficient time for poppet rod 2 to reach the uppermost position before actuator 19 clears driving port 14. In practice, about 0.001 inch has been found suitable. Power piston 7 is within cocking cylinder 51 and reciprocates in substantially gas-tight relationship maintained by power piston seals 41. The upper side of power piston 7 has poppet actuator 19 extending therefrom and in the central portion, actuator pin 20 extends beyond poppet actuator 19 so as to engage poppet valve head 47 at the desired position. The opposite side of power piston 7 comprises gas cushion plunger 26 adapted to engage gas cushion cylinder 25 in cocking cylinder end 11. Power piston rod 8 extends from power piston 7 through power piston rod hole 52 in cocking chamber end 11 in substantially gas-tight relationship maintained by power piston rod seals 45. The lower end of power piston rod 8, external to cocking cylinder 51, is the power output of the thrust generator of this invention and may be used as the thrust source to provide thrust for any suitable device.

The thrust is generated by the expansion of compressed air or gas such as nitrogen, stored in external driving gas accumulator means 12 which is in communication with the upper portion of driving cylinder 50 through driving gas port 33. The accumulators 12 and 13 are pressure tanks, preferably without any inner mechanism. Thus, commercially available accumulators with suitable pressure ratings may be utilized with the bladder or piston removed. The driving force is transmitted to power piston 7 by use of hydraulic oil as a working fluid. The cylinder diameters and lengths are determined by the stroke length and pressure intensification desired.

The hydraulic oil is contained in the portion of driving cylinder 50 and cocking cylinder 51 between floating piston 5 and power piston 7. The oil leaves this volumetric space through oil drain port 16 at cocking cylinder end 10 controlled by oil drain valve 15 which is in communication through conduit 43 with an oil reservoir (not shown) and the inlet of pump 30. Pump 30 is in communication with oil supply valve 17 which controls the supply of hydraulic oil to driving cylinder 50 through oil supply port 18. Any hydraulic pump with sufficient pressure capability and pumping capacity is suitable for use as pump 30. During operation of the thrust generator oil drain valve 15 and oil supply valve 17 may remain open thereby eliminating the need for position switch 24. When it is desired to operate the thrust generator at slow cycling rates, it is necessary to open and close oil drain valve 15 and oil supply valve 17 with each cycle. Power piston 7 is cushioned by gas contained within cocking cylinder 51 between the lower side of power piston 7 and cocking cylinder end 11. The volume of cocking chamber 51 is in communication with cushion gas accumulator 13 through cushion gas port 42 in cocking cylinder end 11. As shown in FIG. 1, cushion gas port 42 is connected to cushion gas cylinder 25 in cocking cylinder end 11. Both the driving and cushioning pneumatic systems are closed systems, having no losses and requiring no fresh supply except makeup for possible leakage.

At the end of the power stroke, both the power piston and the floating piston are at their lowest positions and the driving port is closed by the poppet valve. Since the oil drain valve in communication with the oil drain port is opened the oil occupying the volumetric space above the power piston is drained to the oil reservoir as the compressed cushion gas from the cushion gas accumulator pushes the power piston upward. The power piston rises and since the oil supply valve is also opened high pressure oil enters the driving cylinder pushing the floating piston upward, thereby restoring the cocking gas pressure in the cocking gas accumulator means. During the entry of the high pressure oil to the driving cylinder, the poppet valve is seated within the driving port thereby isolating the driving cylinder from the cocking cylinder.

Figure 2:
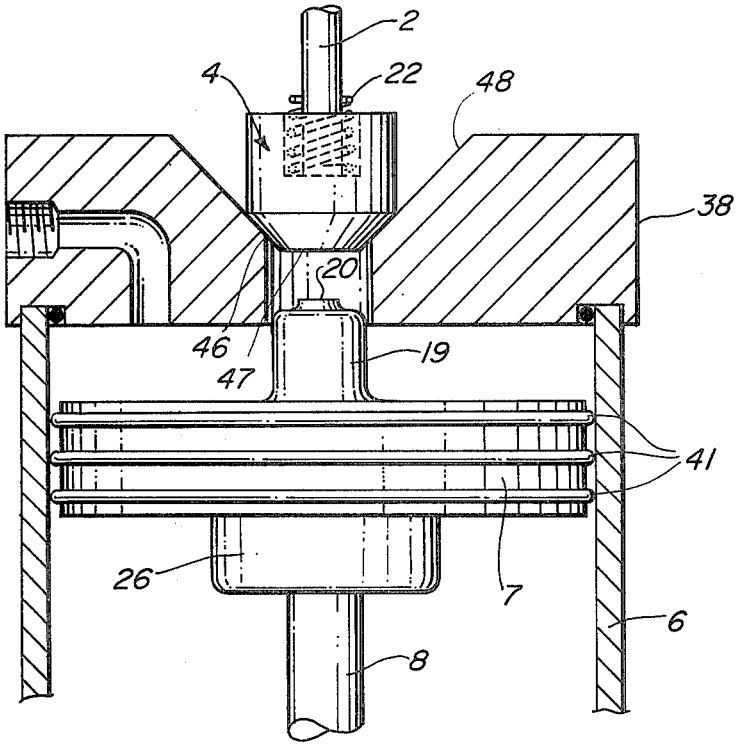
FIG. 2 is a partially sectioned detailed view of the valve actuator and check valve for initiating the firing of the power piston, shown in FIG. 1.

As the driving cylinder is being filled with high pressure oil, the low pressure oil in the cocking cylinder is being drained out and the power piston moving upward. The poppet actuator enters the driving port, as most clearly seen in FIG. 2, and continues upwardly until the actuator pin contacts the poppet valve head dislodging the poppet valve from its seated position in the driving port. The high pressure oil from the driving cylinder rushes into the space between the poppet valve and actuator, and the poppet valve rapidly moves upward due to the oil pressure to its uppermost position against floating piston 5. The end of the poppet rod contacts the position switch 24 at the top of the rod cover. The position switch initiates closing of both the oil supply and oil drain valves. The impact from the poppet valve against the floating piston may be minimized by spring 22 and hydraulic cushion cylinder 23 as shown in FIG. 1. The poppet actuator fits into the driving port with a designed clearance between the poppet actuator and lower portion of the driving port so that after a prescribed period of time the high pressure oil seeps through the clearance and the power piston will move downwardly and quickly accelerate as the poppet actuator clears the driving port. The force is thus transmitted by the power piston rod to the working target.

During the power stroke, the floating piston and poppet valve move downward with the power piston and the high pressure oil continues flowing through the driving port. At the end of the power stroke, the poppet valve seats itself in the driving port thereby cutting off the driving force of the high pressure hydraulic oil. The power piston will then be stopped by the increased pressure of the cushion gas in the cushion gas cylinder as the cushion gas plunger enters it. The poppet valve must close the driving port prior to the end of the power stroke so that sufficient cushion is supplied by the cushion gas to overcome the inertia of the power train to which the power piston rod is attached. This can be accomplished by accurate control of the pressure of the cushion gas and the volume of high pressure oil pumped into the driving chamber.

When the power piston reaches the end of its power stroke, the thrust generator may be stopped by maintaining both the oil drain and oil supply valves in a closed position. To start operation of the cycle requires only the opening of the oil supply and drain valves. For continued operation, the oil drain valve 15 must remain open. If manual control is not applied, the thrust generator will recycle automatically at a reciprocation rate determined by the supply rate of high pressure oil, the operating pressure, the stroke length and the clearance of the poppet actuator in the driving port.

The thrust generator of this invention is particularly well suited for use in combination with a water-jet system as a quiet and efficient pavement breaking and rock fracturing apparatus. The water-jet apparatus utilized in this invention incorporates design considerations providing a desired long pulse duration and relatively flat thrust pattern to provide sufficient energy for both drilling a deep hole in the concrete and creating high hoop stresses to initiate long fractures. The high cycling rate further enhances its efficiency. A maximum water-jet pressure of 100,000 psig can be achieved by utilizing a 2mm diameter nozzle and by charging the driving gas accumulators of the thrust generator to a pressure of about 2650 psig. Under such conditions, each stroke lasts about 100 milliseconds. The water-jet pressure and the stroke duration can be varied by changing pressure of the driving gas accumulators and by using nozzles of varying sizes. The cycling can also be varied depending primarily upon the pump capacity of the hydraulic pumping unit of the thrust generator.

Figure 4:
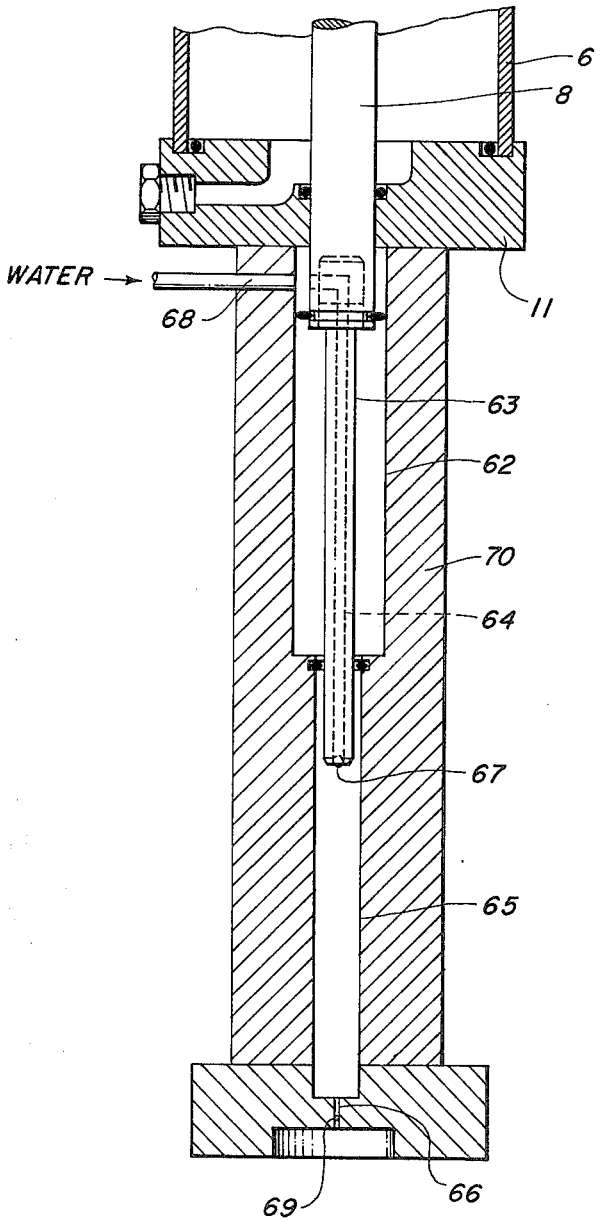
FIG. 4 is a partially sectioned view of an embodiment of a high pressure water jet system for use with the hydraulic-pneumatic thrust generator of this invention.

Referring to FIG. 4, one embodiment of a water-jet system of this invention is illustrated. In FIG. 4, the bottom portion of cocking cylinder 6 is shown with power piston rod 8 extending therefrom through cocking cylinder end 11. High pressure cylinder 70 is shown with power piston rod chamber 62 and water ram chamber 65. The central portion of the end of water ram chamber 65 has nozzle 66 through which the water-jet is directed to the target. Water is introduced to water ram chamber 65 from an exterior supply through conduit 68 in communication with conduit 64 extending down the center of water ram 63. Valve 69 within nozzle 66 prevents the escape of water through the nozzle until the desired pressure is reached. Check valve 67 located near the end of conduit 64 in water ram 63 closes off conduit 64 when the water ram is in operation. It is readily seen that the water ram of the pulsed water-jet system according to this invention is able to develop maximum water pressure at the exit of the nozzle on the order of 90,000 to 100,000 psig. This has been found to be very satisfactory for the fracture of concrete slabs.

The apparatus of this invention can be constructed from materials well known in the art as suitable to withstand the pressures encountered and various materials and methods of obtaining required seals are known to the art. The major components may be fabricated of mild steel, stainless steel, high-strength alloy steels and chrome steel. The seals may be constructed of rubber, plastic, bronze and other metals and composite materials as required by the pressures involved.

The control circuitries required have not been shown, but are well known in the art to achieve the switching and valve control described above. The high pressure oil valves may be controlled by electrical, hydraulic, penumatic or mechanical means energized by pressure sensing or positon sensing means including pressure transducers, position sensors, contact switches and the like, for coaction with the check or poppet valve.

The following Examples are exemplary of preferred embodiments of the apparatus and method of this invention and are not meant to limit the invention in any way.

EXAMPLE 1

Figure 3:
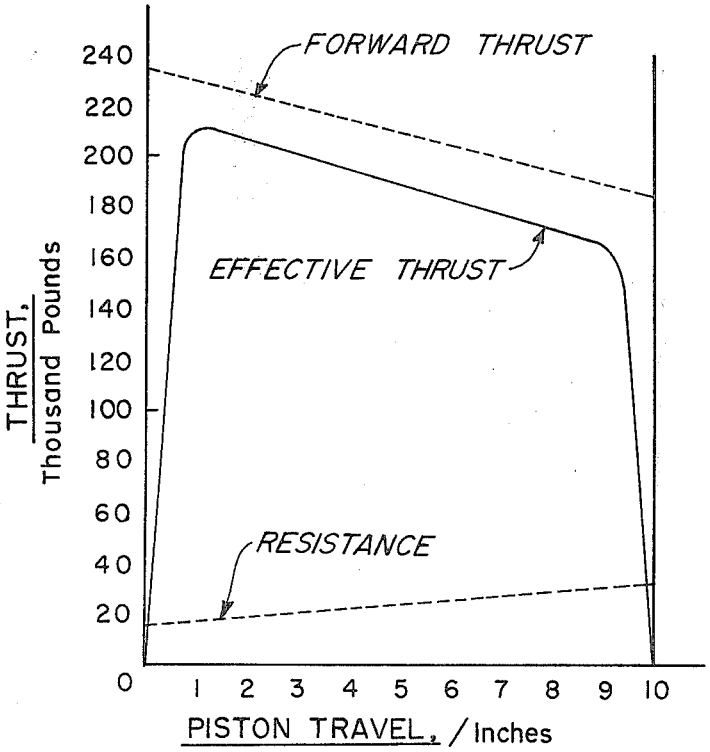
FIG. 3 is a graph showing the thrust-stroke length pattern which can be obtained by the thrust generator of this invention.

A thrust generator was constructed as shown in FIG. 1 having the following dimensions and volumes. The driving cylinder and cocking cylinder each had a 10 inch diameter. The area of the upperside of the floating piston contacted by the driving gas was 78.5 sq. inches. The driving gas accumulator had a volume of 20 gals. and was charged with nitrogen to a pressure of 2450 psig with the floating piston adjacent the driving cylinder end 37. The lower surface of the power piston in contact with the cushion gas had a surface area of 62.5 sq. inches and the external cushion gas accumulator had a volume of 10 gals. The power piston rod had a diameter of 4.5 inches making the total volume of the cushion nitrogen when the power piston was in its upper position with the poppet actuator within the driving port of about 14 gals. This total volume was charged with nitrogen to a pressure of 300 psig. The driving port, in the straight section, was 3 inches in diameter. Hydraulic oil was supplied at a pressure of 3000 psig to the driving cylinder. About 2.7 gals. of oil were introduced driving the floating piston upward thereby raising the pressure of the driving gas in the accumulator to an equal pressure of 3000 psig. The cocking pressure of 300 psig enables the poppet valve actuator to dislodge the poppet from the driving port after the oil drain valve has been opened to initiate the power stroke. The power piston rod produces a maximum of 210,000 lbs. thrust during the power stroke. As shown in FIG. 3, the maximum thrust is reached shortly after the poppet actuator clears the firing port and the thrust level remains quite flat until the cushion plunger 26 reaches the cushion gas cylinder 25. The level of thrust generated can be made even flatter by using a driving gas accumulator of larger volume.

The reciprocating rate is controlled primarily by the rate of supplying of 3000 psig hydraulic oil. A power stroke duration of 0.1 second with fast valve actuation and a reciprocating rate of 6 cycles per minute was obtained with a 21 gal. per minute hydraulic pump. Increasing the pumping capacity to 113 gals. per minute increases the reciprocating rate to 30 cycles per minute.

EXAMPLE II

The apparatus of Example I was attached to a water jet apparatus as shown in FIG. 4. The water-ram had a cross-sectional area of 2.07 sq. inches and a ram stroke of 10 inches. The nozzle orifice area was 0.00487 sq. inch providing a pressure intensification of 38 rendering a maximum water jet pressure of about 100,000 psig. The apparatus used in this Example was limited to a maximum of 50,000 psig water jet pressure, limited by the seals. Cast concrete slabs of 5700 psi compressive strength (16 × 16 × 6 inches) have been fractured with one center shot at 50,000 psig water pressure. Occasionally, more than one shot has been required to effect fracture due to a solid aggregate being in the path of the water jet, thus reducing the effective jet penetration.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention. I claim:

1. A thrust generator comprising:

a substantially gas-tight driving cylinder, a floating piston adapted for substantially gas-tight reciprocating movement within said driving cylinder, a driving gas accumulator means in communication with a first end of said driving cylinder, the second end of said driving cylinder having a driving port;

a substantially gas-tight cocking cylinder, a power piston adapted for substantially gas-tight reciprocating movement within said cocking cylinder, a cushion gas accumulator means in communication with a first end of said cocking cylinder, the second end of said cocking cylinder having a driving port in communication with the driving port of said driving cylinder, said power piston having a poppet actuator means on the side of the piston toward said second end and a power piston rod on the other side of said piston adapted for substantially gas-tight reciprocating movement through a power piston rod hole in said first end delivering said thrust from said thrust generator;

a poppet valve adapted for seating in substantially fluid-tight relation with a seating means in said driving port towards said driving cylinder, the other end of said poppet valve having a poppet valve rod adapted for substantially gas-tight reciprocating movement through a poppet rod hole in said floating piston and said first end of said driving cylinder, the other end of said driving port adapted for clearance passage of said poppet actuator;

a hydraulic fluid reservoir in communication with a hydraulic fluid pump and supply valve means in communication with said second end of said driving cylinder and a hydraulic fluid drain valve means in communication with said second end of said cocking cylinder and said pump whereby high pressure hydraulic fluid is delivered to the second end of said driving cylinder by said pump, passes through said driving port providing the force to move said power piston and drain from the second end of said cocking cylinder through said hydraulic fluid drain valve means to said reservoir; and control means for operation of said hydraulic fluid supply valve and drain valve means.

2. The thrust generator of claim 1 wherein said power piston has a gas cushion plunger on the side of the piston adjacent said power piston rod and a cushion gas cylinder in the first end of said cocking cylinder in communication with said cushion gas accumulator means and adapted for entry of said cushion gas plunger thereby providing a cushioning force as said gas cushion plunger enters said cushion gas cylinder.

3. The thrust generator of claim 1 wherein said floating piston has a hydraulic cushion cylinder adjacent said poppet rod hole and said poppet valve has a portion adapted for entry into said hydraulic cushion cylinder thereby providing a cushioning force for the poppet rod as the poppet valve enters said hydraulic cushion cylinder.

4. The thrust generator of claim 3 additionally having a spring encircling said poppet rod and adapted to seat against said poppet valve and said floating piston providing a cushioning effect.

5. The thrust generator of claim 1 wherein said poppet rod exterior to said driving cylinder is enclosed within a poppet rod cover.

6. The thrust generator of claim 5 wherein a sensing means is actuated by the end of said poppet rod reaching its extreme movement exterior to said driving cylinder, said sensing means actuating said hydraulic fluid drain and supply valves.

7. The thrust generator of claim 1 wherein said poppet valve seating means is a replaceable insert seating means.

8. The thrust generator of claim 1 wherein said poppet actuator has an actuator pin extending therefrom for contact with said poppet valve.

9. The thrust generator of claim 8 wherein said clearance passage of said poppet actuator is about 0.001 inch.

10. The thrust generator of claim 1 wherein said power piston rod delivers the trust from said thrust generator to a high pressure cylinder having a power piston rod chamber within which said power piston rod reciprocates in substantially fluid-tight relation and a water ram chamber in which a water ram extending from said power piston rod reciprocates in substantially fluid-tight relation, means for injecting water into said water ram chamber and a nozzle means at the end of said water ram chamber and control means whereby water is supplied to said water ram chamber when said water ram is at one end of its stroke and said water ram by action of said power piston rod high pressurizes said water within said water ram chamber providing a high pressure water jet through said nozzle.

11. A process for pulsed thrust generation having pneumatic cocking and cushioning action and hydraulic transmission of the driving force comprising:

draining hydraulic fluid from a cocking cylinder by return movement of a power piston actuated by compressed cushion gas, concurrently supplying high pressure hydraulic fluid to a driving cylinder moving a floating piston to restore driving gas pressure, the cocking cylinder and driving cylinder being isolated from each other by a seated poppet valve;

releasing said seated poppet valve from a driving port by a poppet actuator on said power piston when the power piston is at the end of its return stroke moving the poppet valve by high pressure oil in the driving cylinder to a position adjacent said floating piston;

rapidly accelerating the power piston power stroke by the high pressure of said hydraulic fluid passing from the driving cylinder to the cocking cylinder through said driving port providing desired thrust through the power piston and its rod;

moving said floating piston and poppet valve for seating in said driving port by action of the pressurized driving gas thereby removing the driving force of the high pressure hydraulic oil in said cocking cylinder prior to the completion of the power stroke; and repeating said thrust generation cycle.

* * * * *